US007261765B2

(12) United States Patent
Katayama

(10) Patent No.: US 7,261,765 B2
(45) **Date of Patent: *Aug. 28, 2007**

(54) ELECTROSTATIC PRECIPITATOR

(75) Inventor: Hideo Katayama, Tokyo (JP)

(73) Assignee: Anzai, Setsu, Tokyo (JP)

( * ) Notice: Subject to any disclaimer, the term of this patent is extended or adjusted under 35 U.S.C. 154(b) by 81 days.

This patent is subject to a terminal disclaimer.

(21) Appl. No.: 11/026,738

(22) Filed: Dec. 29, 2004

(65) Prior Publication Data

US 2006/0137528 A1 Jun. 29, 2006

(51) Int. Cl.
*B03C 3/68* (2006.01)

(52) U.S. Cl. ..... 96/19; 55/DIG. 1; 96/22; 96/63; 96/80; 96/88; 96/96; 323/903

(58) Field of Classification Search ..... 96/75–80, 96/19, 21–24, 60–63, 88, 96; 323/903; 55/DIG. 1, 55/DIG. 30

See application file for complete search history.

(56) References Cited

U.S. PATENT DOCUMENTS

| | | | | |
|---|---|---|---|---|
| 1,357,466 A | | 11/1920 | Möller | 95/79 |
| 1,507,687 A | * | 9/1924 | Schmidt | 95/79 |
| 3,507,096 A | * | 4/1970 | Hall et al. | 96/21 |
| 3,668,836 A | | 6/1972 | Richardson et al. | 96/66 |
| 4,218,225 A | | 8/1980 | Kirchhoff et al. | 96/32 |
| 4,308,105 A | * | 12/1981 | Schiffers et al. | 202/197 |
| 4,381,927 A | * | 5/1983 | Noll | 96/79 |
| 4,490,159 A | * | 12/1984 | Matts | 95/3 |
| 4,822,381 A | * | 4/1989 | Mosley et al. | 95/79 |
| 5,059,219 A | * | 10/1991 | Plaks et al. | 96/77 |
| 5,707,428 A | * | 1/1998 | Feldman et al. | 96/54 |

FOREIGN PATENT DOCUMENTS

| | | | | |
|---|---|---|---|---|
| GB | 913 172 | | 12/1962 | |
| JP | 52-6178 | * | 1/1977 | 96/76 |
| JP | 56-12011 | * | 2/1981 | 55/DIG. 30 |

* cited by examiner

*Primary Examiner*—Richard L. Chiesa
(74) *Attorney, Agent, or Firm*—Hogan & Hartson LLP

(57) ABSTRACT

An electrostatic precipitator having a plurality of electrostatic precipitation units positioned within the electrostatic precipitator. Each of the electrostatic precipitation units includes a plurality of negative wire electrodes and a plurality of positive electrode plates. The electrostatic precipitation units are arranged such that spacing between the negative wire electrodes of a first electrostatic precipitation unit is a first distance apart, and spacing between the negative wire electrodes of additional electrostatic precipitation units is less than the spacing between the negative wire electrodes of the first electrostatic precipitation unit. Moreover, a variable voltage is applied to the each of the electrostatic precipitation units between the positive electrode plates and the negative wire electrodes so as to cause particles in the exhaust gas to adhere to the positive electrode plates.

15 Claims, 5 Drawing Sheets

ELECTROSTATIC PRECIPITATOR

BACKGROUND OF THE INVENTION

1. Field of the Invention

The present invention relates to electrostatic precipitation technology and, in particular, to an electrostatic precipitator.

2. Description of the Related Art

Conventional electrostatic precipitator clean exhaust gas by applying a high voltage between two electrodes (+) and (−) which causes particles in the exhaust gas to be deposited on the (+) electrode. For a constant voltage, the electrical resistance between the electrodes of (+) and (−) varies with the quantity of particles in the exhaust gas. When the resistance is changed in normal operation range, dust precipitation efficiency may be impaired in some conditions. For example, an electrical short may occur at low resistance depending on the quantity of dust in the electrostatic precipitator and/or on the (+) electrode.

There currently exists a need to continuously conduct particle precipitation within the normal operation range irrespective of the quantity and size of the particles in the exhaust gas so as to improve dust precipitation efficiency.

SUMMARY OF THE INVENTION

The aforementioned needs are satisfied with an electrostatic precipitator comprising, in one embodiment, an intake pipe attached to a first exterior portion of the electrostatic precipitator that receives exhaust gas and an exhaust gas inflow control fan attached to the intake pipe so as to regulate the flow of exhaust gas into electrostatic precipitator. In addition, the electrostatic precipitator further comprises a plurality of electrostatic precipitation units positioned within the electrostatic precipitator, wherein each of the electrostatic precipitation units include a plurality of negative wire electrodes and a plurality of positive electrode plates, and wherein spacing between the negative wire electrodes of a first electrostatic precipitation unit is a first distance apart, and wherein spacing between the negative wire electrodes of a second electrostatic precipitation unit is less than the spacing between the negative wire electrodes of the first electrostatic precipitation unit, and wherein a variable voltage is applied to the each of the electrostatic precipitation units between the positive electrode plates and the negative wire electrodes so as to cause particles in the exhaust gas to adhere to the positive electrode plates. In addition, the electrostatic precipitator still further comprises a plurality of electrical control circuits electrically connected to the plurality of electrostatic precipitation units that individually control the variable voltages applied to the electrostatic precipitation units, wherein the amount of voltage applied to the electrostatic precipitation units depends, at least in part, on the characteristics of the particles in the exhaust gas. Moreover, the electrostatic precipitator still further comprises a discharge pipe attached to a second exterior portion of the electrostatic precipitator that discharges exhaust gas from the electrostatic precipitator.

In one aspect, the first electrostatic precipitation unit comprises a first amount of negative wire electrodes, and wherein the second electrostatic precipitation unit comprises a greater amount of negative wire electrodes than the first electrostatic precipitation unit. In addition, the plurality of electrostatic precipitation units further comprises a third electrostatic precipitation unit, and wherein the third electrostatic precipitation unit comprises a greater amount of negative wire electrodes than the second electrostatic precipitation unit, and wherein spacing between the negative wire electrodes of the third electrostatic precipitation unit is less than the spacing between the negative wire electrodes of the second electrostatic precipitation unit.

Moreover, the plurality of electrical control circuits comprises a first electrical control circuit electrically connected to the first electrostatic precipitation unit, a second electrical control circuit electrically connected to the second electrostatic precipitation unit, and a third electrical control circuit electrically connected to the third electrostatic precipitation unit. In addition, each of the electrical control circuits are adapted to individually control the variable voltages applied to their respective electrostatic precipitation units.

In another aspect, the pluralities of electrostatic precipitation units are vertically arranged within the electrostatic precipitator. In addition, the electrostatic precipitator further comprises an electrical resistance sensor in the exhaust gas intake pipe, wherein the exhaust gas inflow control fan operates when the resistance measured by the resistance sensor is at a pre-determined level.

In still another aspect, each of the control circuits includes a control section having an electric current sensor, and wherein the control section operates in accordance with the magnitude of the electric current detected by the electric current sensor so as to regulate the current between the positive electrode plates and the negative wire electrodes.

In yet another aspect, each of the control circuits comprises an automatic control circuit in which a current sensor, control unit, mechanical rotatory control unit, a variable voltage transformer, a high voltage transformer, and a diode rectifier are connected together so that the rotating section of the variable voltage transformer operates in response to the changes in the particle characteristics between the positive electrode plates and the negative wire electrodes of each electrostatic precipitation unit so as to vary the voltage therebetween.

As will described in greater detail herein below, the voltages applied between the positive (+) electrode plates and the negative (−) wire electrodes vary among the first, second and third electrostatic precipitation units. In addition, these voltages are controlled by monitoring the currents going to each electrostatic precipitation units with sensors. Moreover, there is also a sensor in the exhaust gas intake pipe to control the flow volume of the exhaust gas so the resistance between the (+) and (−) electrodes, which can vary with the number, size, and/or density of the particles in the exhaust gas, is maintained and/or regulated in a normal operational range.

These and other objects and advantages of the present teachings will become more fully apparent from the following description taken in conjunction with the accompanying drawings.

DETAILED DESCRIPTION OF THE PREFERRED EMBODIMENTS

Reference will now be made to the drawings, wherein like numerals refer to like parts throughout. The present teachings relate to an electrostatic precipitator for improving electrostatic precipitation efficiency.

Figure 1:
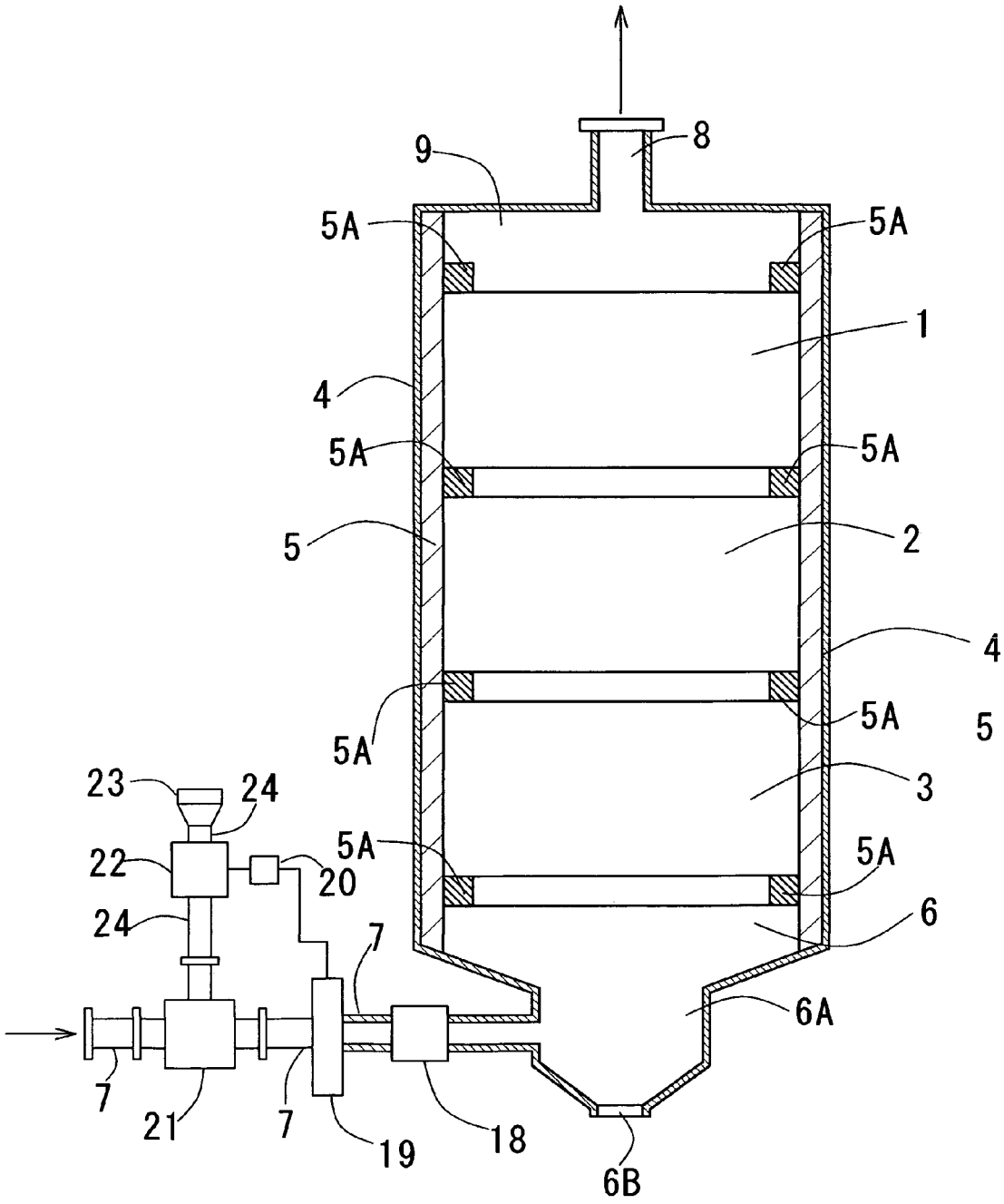
FIG. 1 shows a sectional view of an electrostatic precipitator.

FIG. 1 shows a sectional view of an electrostatic precipitator 4 comprising electrical insulation material 5 attached to an interior portion or wall thereof and a plurality of electrostatic precipitation units 1, 2, 3 vertically arranged therein. The electrostatic precipitation units 1, 2, 3 are fixedly attached to the electrical insulation material 5 via mounting components 5A.

In operation, exhaust gas enters the electrostatic precipitation device 4 via an exhaust gas intake pipe 7 and passes therethrough into an interior region 6 of the electrostatic precipitation device 4. From there, as shown in FIG. 1, the electrostatic precipitation device 4 is arranged so that the flow of exhaust gas sequentially passes through the electrostatic precipitation units 3, 2, 1, respectively, to an exhaust gas discharge pipe 8. The exhaust gas stays inside the electrostatic precipitation units 1, 2, 3 for a pre-determined period of time so that dust particles in the exhaust gas can be removed therefrom.

An electrical resistance sensor 19 is provided in the exhaust gas intake pipe 7. An exhaust gas inflow control fan 18 operates normally, and electrical resistance sensor 19 is measured of less than 10 $\Omega/cm^2$, a rotary air valve 22 is operated by a rotary control unit 21 to air inflow to the exhausted gas air mixing unit 20 via an air intake pipe 24 for increase the electrical resistance of the exhausted gas in the pipe 7. A rotation speed is changeable from 0 r.p.m. to maximum in rotation speed of 1,800 r.p.m. when from 10 $\Omega/cm^2$ of resistance to 0 $\Omega/cm^2$ of resistance of gas in the exhausted gas intake pipe 7 for holding an electrical resistance is more than 10 $\Omega/m^2$(1000 $\Omega/cm^2$). Therefore the rotary air valve 22 operate to control the electrical resistance of exhausted gas is high resistance above 10 $\Omega/m^2$ for treatment exhausted gas in the electrostatic precipitator. During operation, exhaust gas passes from the intake pipe 7 via the exhaust gas air mixing unit 21 and exhaust gas inflow fan 18 into the interior region 6 adjacent to the lower portion of the electrostatic precipitator device 4. From here, the exhaust gas can pass through or within the electrostatic precipitation units 1, 2, 3 and then discharge upwards through the discharge pipe 8 in a manner as previously described.

The electrostatic precipitation device 4 further comprises a damper 6A and a discharge outlet 6B in the lower portion thereof. The damper 6A operates if the rate of flow of the exhaust gas from the exhaust gas intake pipe 7 drops for a time. The discharge outlet 6B is for the purpose of discharging accumulated dust particles.

It should be appreciated that the electrostatic precipitator 4 shown in FIG. 1 shows one example embodiment of the present teachings and should not limit the scope of the present teachings, wherein the electrostatic precipitator disclosed herein may comprise one or more electrostatic precipitation units without departing from the scope of the present teachings.

Figure 2:
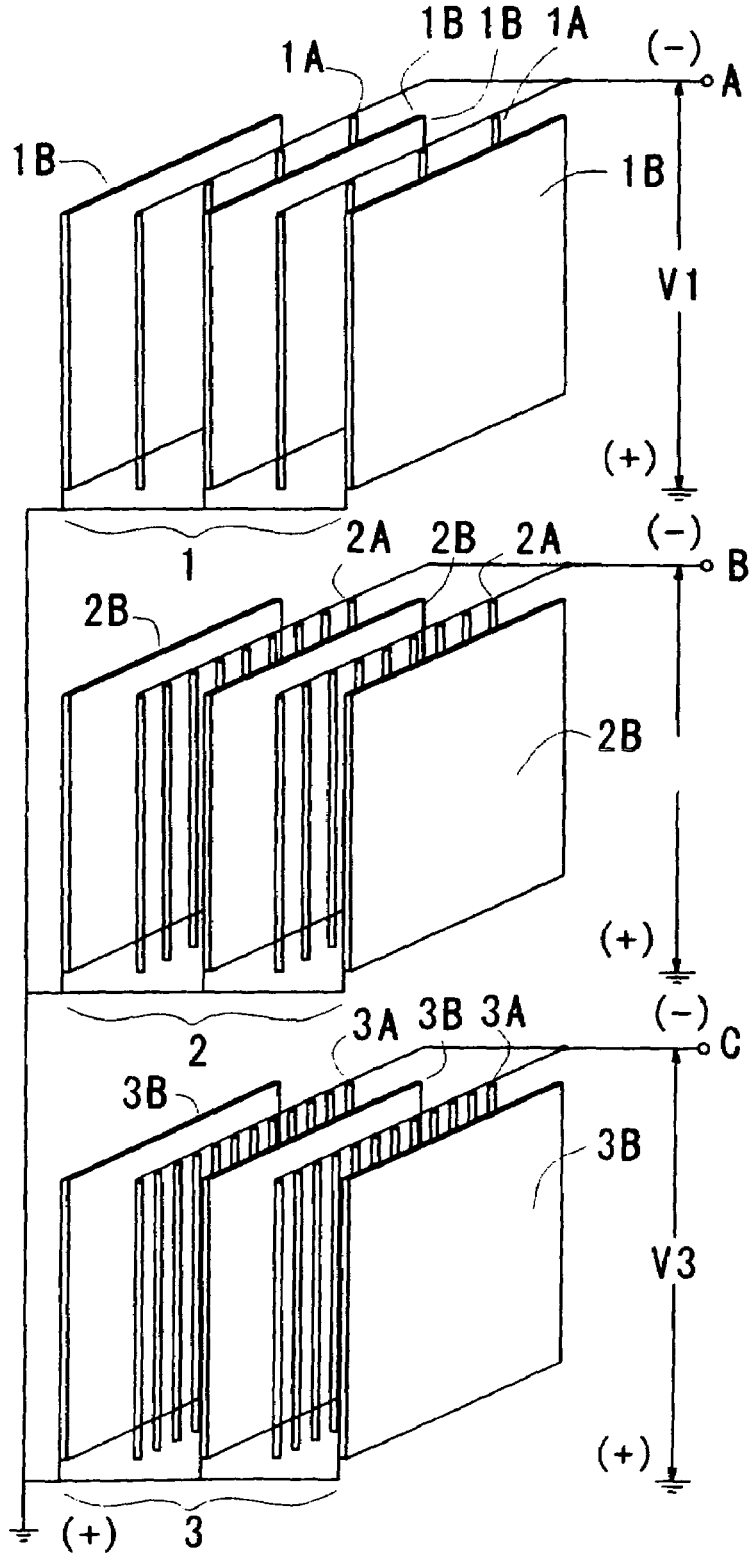
FIG. 2 shows perspective views of electrostatic precipitation units.

FIG. 2 shows perspective views of the electrostatic precipitation units 1, 2, 3 comprising a first, second, and third electrostatic precipitation unit 1, 2, 3. Each of the electrostatic precipitation units 1, 2, 3 comprise a plurality of electrostatic precipitation elements including one or more negative (−) wire electrodes 1A, 2A, 3A and one or more positive (+) electrode plates 1B, 2B, 3B.

As shown in FIG. 2, the voltage V1 is applied between the electrode plates 1B on the positive (+) side and the wire electrodes 1A on the negative (−) side for the first electrostatic precipitation unit 1. The voltage V2 is applied between the electrode plates 2B on the (+) side and the wire electrodes 2A on the (−) side for the second electrostatic precipitation unit 2. The voltage V3 is applied between the electrode plates 3B on the (+) side and the wire electrodes 3A on the (−) side for the third electrostatic precipitation unit 3. In one aspect, the applied voltages V1, V2, V3 are controlled in accordance with the characteristics, such as density and size, of the particles in the exhaust gas.

In the electrostatic precipitation unit 3, the voltage V3 between the electrode plates 3B on the (+) side and the wire electrodes 3A on the (−) side causes the various particles in the exhaust gas to adhere to the electrode plates 3B on the (+) side.

In the electrostatic precipitation unit 2, the voltage V2 between the electrode plates 2B on the (+) side and the wire electrodes 2A on the (−) side causes the various particles in the exhaust gas to adhere to the electrode plates 2B on the (+) side. In one aspect, the number of small size particles deposited is greater than that for the electrostatic precipitation unit 3.

In the electrostatic precipitation unit 1, the voltage V1 between the electrode plates 1B on the (+) side and the wire electrodes 1A on the (−) side causes the various particles in the exhaust gas to adhere to the electrode plate 1B on the (+) side. In one aspect, the number of smaller diameter particles deposited is greater than that for the electrostatic precipitation unit 2.

FIG. 2 shows one example of the present teachings, wherein negative voltages V1, V2, V3 are applied to the electrostatic precipitation units 1, 2, 3. However, it should be appreciated by those skilled in the art that the polarity may be reversed such that positive voltages are applied to the electrostatic precipitation units 1, 2, 3 without departing from the scope or function of the present teachings.

Figure 3:
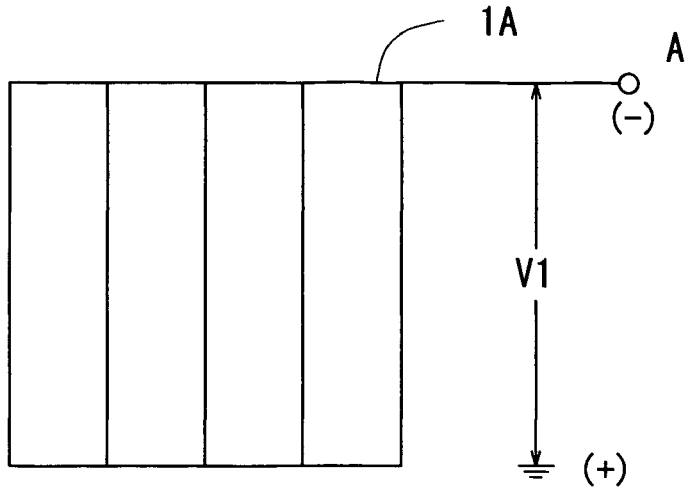
FIGS. 3–5 show schematic views of wire electrodes.
Figure 4:
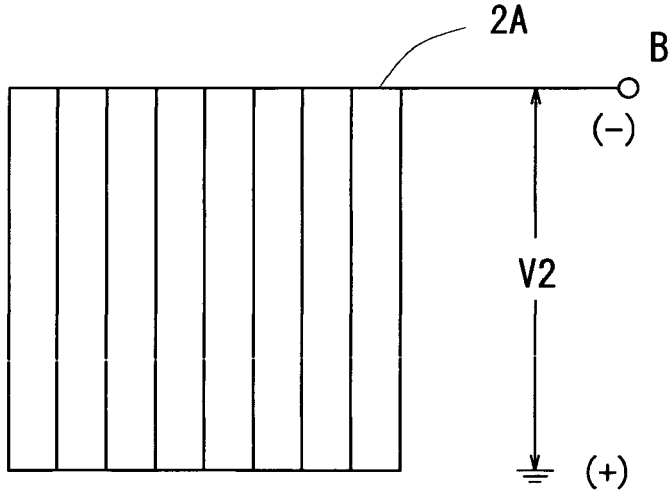
Figure 5:
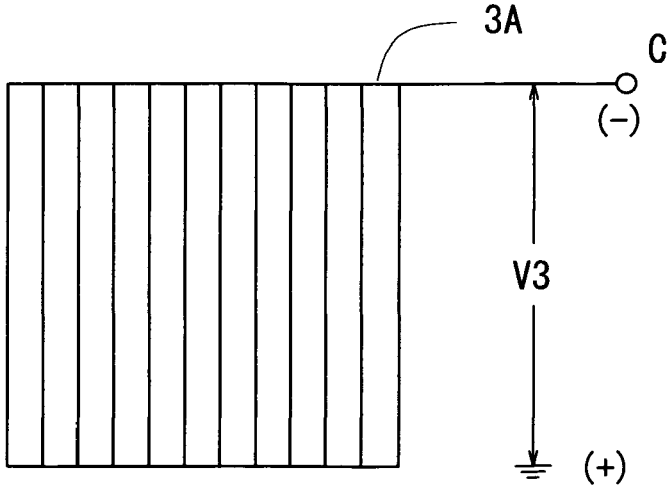

FIGS. 3–5 show schematic views of the wire electrodes. As shown in FIG. 2 in combination with FIGS. 3–5, the first electrostatic precipitation unit 1 comprises a first amount of (−) wire electrodes and spacing between the (−) wire electrodes 1A of the first electrostatic precipitation unit 1 is a first distance apart. In addition, a second electrostatic precipitation unit 2 comprises at least a greater amount of (−) wire electrodes 2A than the first electrostatic precipitation unit 1 and spacing between the (−) wire electrodes 2A of the second electrostatic precipitation unit 2 is less than the spacing between the (−) wire electrodes 1A of the first electrostatic precipitation unit 1. Moreover, a third electrostatic precipitation unit 3 comprises at least a greater amount of (−) wire electrodes 3A than the second electrostatic precipitation unit 2 and spacing between the (−) wire electrodes 3A of the third electrostatic precipitation unit 3 is less than the spacing between the (−) wire electrodes 2A of the second electrostatic precipitation unit 2.

Figure 6:
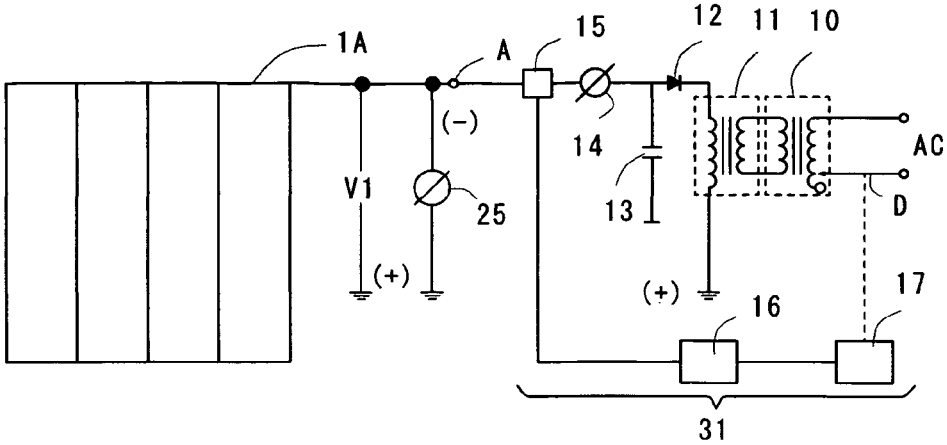
FIGS. 6–8 show schematic views of control circuits.
Figure 7:
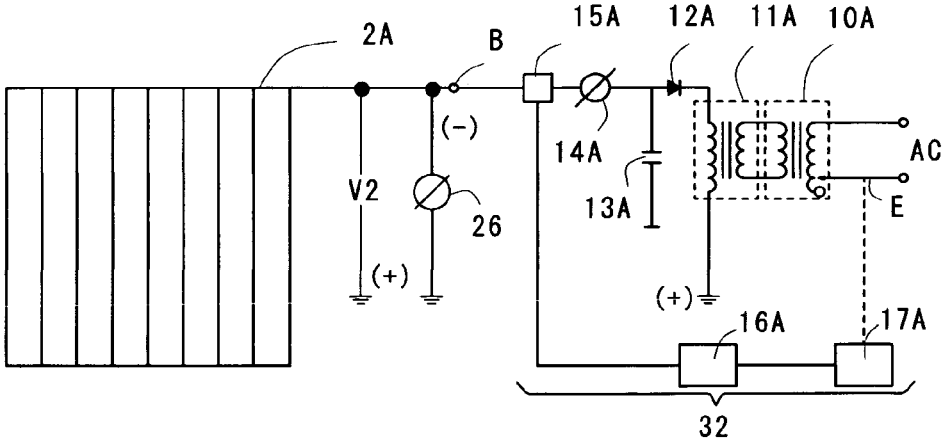
Figure 8:
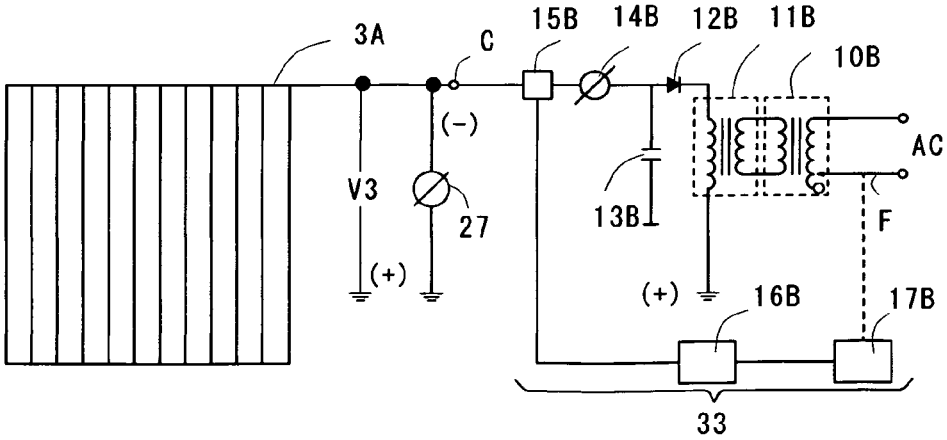

FIGS. 6–8 show schematic views of electrical control circuits 31, 32, 33 for each of the electrostatic precipitation units 1, 2, 3, respectively.

The electrostatic precipitation units 1, 2, 3 can be individually controlled with the electrical control circuits 31, 32, 33. In one aspect, the voltages V1, V2, V3 applied between the (+) and (−) electrodes in the above configurations are controlled by means of the electrical control circuits 31, 32, 33 shown in FIGS. 6–8.

Figure 9:
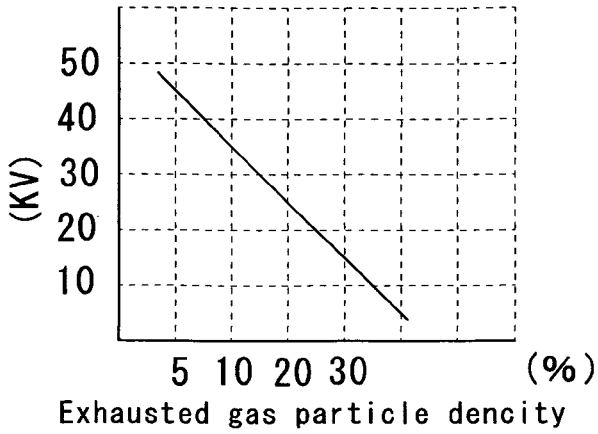
FIGS. 9–11 show various graphs depicting examples of the relationship between electrical resistance and exhaust gas particle density.
Figure 10:
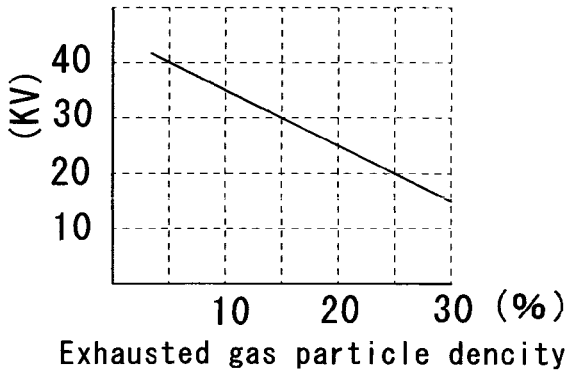
Figure 11:
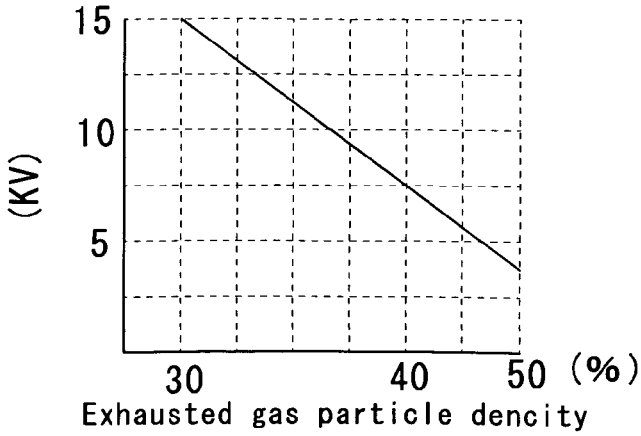

FIGS. 9–11 show various graphs depicting examples of the relationship between electrical resistance and exhaust gas particle density. For example, with reference to electrostatic precipitation unit 1, FIG. 9 shows that for a particle density of 10%, the voltage is 35 kV. In another example, FIGS. 9–11 show that the voltage decreases as the particle density increases.

Referring to FIG. 6, the electric control circuit 31 comprises a variable voltage transformer 10, a high voltage transformer 11, a diode rectifier 12, a condenser 13, a current meter 14, an electric current sensor 15, a control section 16, a mechanical rotatory control section 17, and variable voltage transformer rotating contact section D.

In one aspect with reference to FIGS. 6 and 9, the current between the electrode plates 1B on the (+) side and the electrode wires 1A on the (−) side increases when the exhaust gas particle density increases. The control section 16 operates in accordance with the magnitude of the electric current detected by the electric current sensor 15. The control section 16 is adapted to rotate the variable voltage transformer 10 linked to the mechanical rotatory control section 17 so as to drop the voltage produced at the secondary side of the high voltage transformer 11 to a level at which there will be no spark discharge between the electrode plates 1B on the (+) side and the electrode wires 1A on the (−) side. The diode 12 functions as a rectifier which applies a negative voltage to the electrode wires 1A on the (−) side. The voltmeter 25 measures voltage between the electrode plates 1B on the (+) side and the electrode wires 1A on the (−) side. The condenser 13 smoothes the output voltage waveform from the diode 12.

FIGS. 7–8 show electrical control circuits 32, 33 for the prevention of spark discharge between the (+) and (−) electrodes of electrostatic precipitation units 2, 3, respectively. In one aspect, control circuits 32, 33 are similar in scope and function to the control circuit 31 as described above with reference to FIG. 6.

As shown in FIGS. 7–8, the control circuits 32, 33 comprise variable voltage transformers 10A, 10B, high voltage transformers 11A, 11B, diode rectifiers 12A, 12B, condensers 13A, 13B, voltmeters 26, 27, electric current sensors 15A 15B and ammeters 14A, 14B, control sections 16A, 16B, mechanical rotatory control sections 17A, 17B, and variable voltage transformer rotating contact sections as E and F.

In one aspect, by means of the above configurations, the voltage between the electrode plates on the (+) side and electrode wires on the (−) side of the electrostatic precipitation units 1, 2, 3 is automatically increased or decreased depending on the exhaust gas particle density so that the electrostatic precipitation units 1, 2, 3 operate in a normal range.

Although the preferred embodiments of the present teachings have shown, described, and pointed out the fundamental novel features of the invention as applied to those embodiments, it will be understood that various omissions, substitutions, and changes in the form of the detail of the device illustrated may be made by those skilled in the art without departing from the spirit of the present teachings. Consequently, the scope of the invention should not be limited to the foregoing description but is to be defined by the appended claims.

What is claimed is:

1. An electrostatic precipitator comprising:

an intake pipe attached to a first exterior portion of the electrostatic precipitator that receives exhaust gas;

an exhaust gas inflow fan attached to the intake pipe so as to regulate the flow of exhaust gas into the electrostatic precipitation device;

a plurality of electrostatic precipitation units positioned within the electrostatic precipitator, wherein each of the electrostatic precipitation units include a plurality of negative wire electrodes and a plurality of positive electrode plates, and wherein spacing between the negative wire electrodes of a first electrostatic precipitation unit is a first distance apart, and wherein spacing between the negative wire electrodes of a second electrostatic precipitation unit is less than the spacing between the negative wire electrodes of the first electrostatic precipitation unit, and wherein a variable voltage is applied to the each of the electrostatic precipitation units between the positive electrode plates and the negative wire electrodes so as to cause particles in the exhaust gas to adhere to the positive electrode plates; a plurality of electrical control circuits electrically connected to the plurality of electrostatic precipitation units that individually control the variable voltages applied to the electrostatic precipitation units, wherein the amount of voltage applied to the electrostatic precipitation units depends, at least in part, on the characteristics of the particles in the exhaust gas; and a discharge pipe attached to a second exterior portion of the electrostatic precipitator that discharges exhaust gas from the electrostatic precipitator.

2. The electrostatic precipitator of claim 1, wherein the first electrostatic precipitation unit comprises a first amount of negative wire electrodes, and wherein the second electrostatic precipitation unit comprises a greater amount of negative wire electrodes than the first electrostatic precipitation unit.

3. The electrostatic precipitator of claim 2, wherein the plurality of electrostatic precipitation units further comprises a third electrostatic precipitation unit, and wherein the third electrostatic precipitation unit comprises a greater amount of negative wire electrodes than the second electrostatic precipitation unit, and wherein spacing between the negative wire electrodes of the third electrostatic precipitation unit is less than the spacing between the negative wire electrodes of the second electrostatic precipitation unit.

4. The electrostatic precipitator of claim 3, wherein the plurality of electrical control circuits comprises a first electrical control circuit electrically connected to the first electrostatic precipitation unit, a second electrical control circuit electrically connected to the second electrostatic precipitation unit, and a third electrical control circuit electrically connected to the third electrostatic precipitation unit.

5. The electrostatic precipitator of claim 1, wherein the plurality of electrostatic precipitation units are vertically arranged within the electrostatic precipitator.

6. The electrostatic precipitator of claim 1, further comprising an electrical insulation material attached to an interior portion of the electrostatic precipitator.

7. The electrostatic precipitator of claim 1, wherein the electrostatic precipitation units are fixedly attached to the electrical insulation material via one or more mounting components.

8. The electrostatic precipitator of claim 1, further comprising an electrical resistance sensor in the exhaust gas intake pipe, wherein a rotary air valve operates when the electrical resistance of the exhaust gas in the intake pipe measured by the electrical resistance sensor is pre-determined level of the intake exhaust gas electrical resistance.

9. The electrostatic precipitator of claim 1, further comprising an air intake unit connected to a rotary air valve via an air intake valve.

10. The electrostatic precipitator of claim 1, further comprising an air intake unit connected to a rotary air valve via an air intake pipe front position.

11. The electrostatic precipitator of claim 1, further comprising an exhaust gas air mixing unit provided between an air intake pipe end position and the exhaust gas intake pipe before the exhaust gas inflow fan.

12. The electrostatic precipitator of claim 1, further comprising a rotary control unit connected between an electrical resistance sensor and a rotary air valve wherein the rotary control unit controls the rotation speed of the rotary air valve when the electrical resistance of intake exhaust gas is at a pre-determined level.

13. The electrostatic precipitator of claim 1, wherein the characteristics of the particles in the exhaust gas includes at least one of density and size of the particles.

14. The electrostatic precipitator of claim 1, wherein each of the control circuits includes a control section having an electric current sensor, and wherein the control section operates in accordance with the magnitude of the electric current detected by the electric current sensor so as to regulate the current between the positive electrode plates and the negative wire electrodes.

15. The electrostatic precipitator of claim 1, wherein each of the control circuits comprises an automatic control circuit in which a current sensor, control unit, mechanical rotator control unit, a variable voltage transformer, a high voltage transformer, and a diode rectifier are connected together so that the rotating section of the variable voltage transformer operates in response to the changes in the particle characteristics between the positive electrode plates and the negative wire electrodes of each electrostatic precipitation unit so as to vary the voltage therebetween.

* * * * *